United States Patent [19]

Combette et al.

[11] 4,074,845

[45] Feb. 21, 1978

[54] DEVICE FOR MAINTAINING IN POSITION THE PISTON OF A FASTENER TOOL

[76] Inventors: Marc Combette, 116 Rue des Moulins; Jean Ollivier, 89 Ave. des Beaumes, both of Valence (Drome), France

[21] Appl. No.: 723,846

[22] Filed: Sept. 16, 1976

[30] Foreign Application Priority Data

Sept. 16, 1975 France ..... 75 28401

[51] Int. Cl.[2] ..... B25C 1/18

[52] U.S. Cl. ..... 227/10; 60/636; 74/531; 92/167; 188/67

[58] Field of Search ..... 188/67, 129; 248/414; 74/531; 92/167, 23; 60/636; 227/8, 9, 10, 11

[56] References Cited

U.S. PATENT DOCUMENTS

| | | | |
|---|---|---|---|
| 2,869,391 | 1/1959 | Brock | 74/531 X |

FOREIGN PATENT DOCUMENTS

| | | | |
|---|---|---|---|
| 1,804,491 | 5/1970 | Germany | 227/10 |
| 2,202,230 | 7/1973 | Germany | 188/67 |
| 708,692 | 5/1954 | United Kingdom | 227/9 |

*Primary Examiner*—George E. A. Halvosa
*Attorney, Agent, or Firm*—William W. Jones; Paul J. Lerner

[57] ABSTRACT

The device comprises on the front end portion of the plunger or piston a retaining ring mounted in the barrel with the interpositioning of a joint in such a way that the bore of the ring is slightly off-center relative to the piston axis when the joint is not deformed.

5 Claims, 5 Drawing Figures

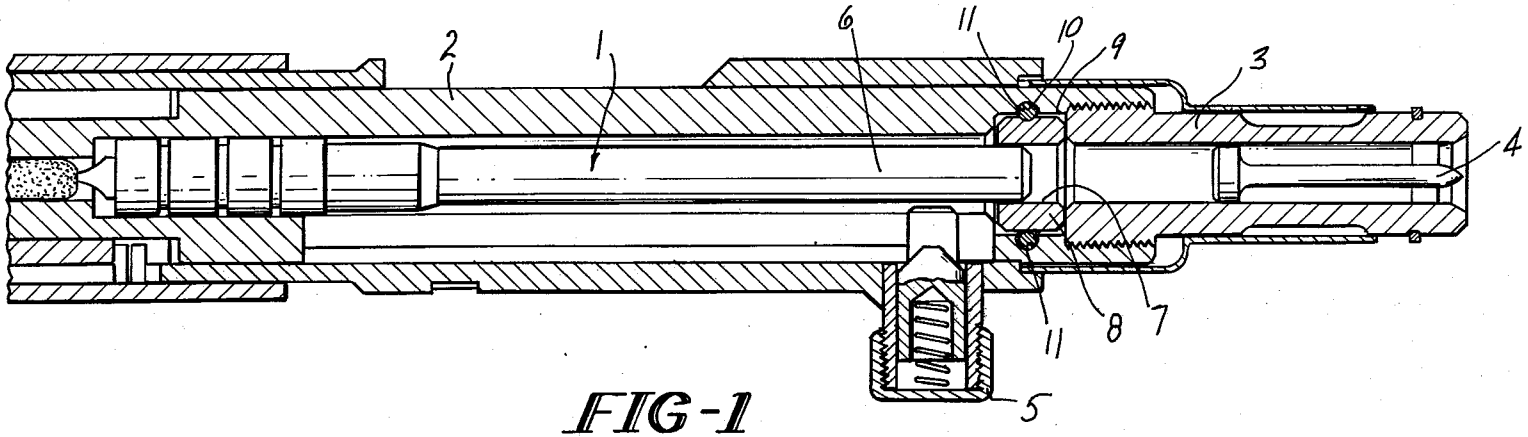
FIG-1
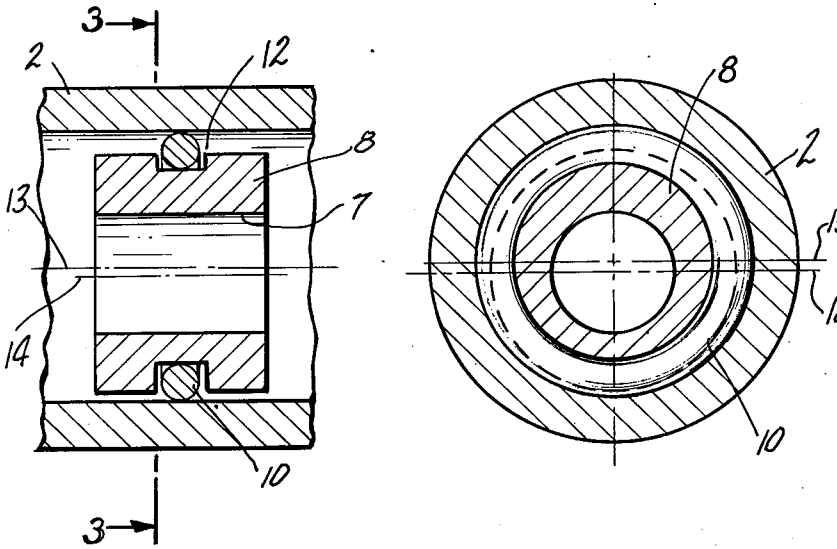
FIG-2
FIG-3
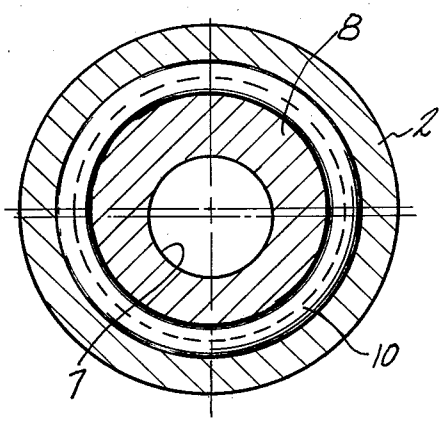
FIG-4
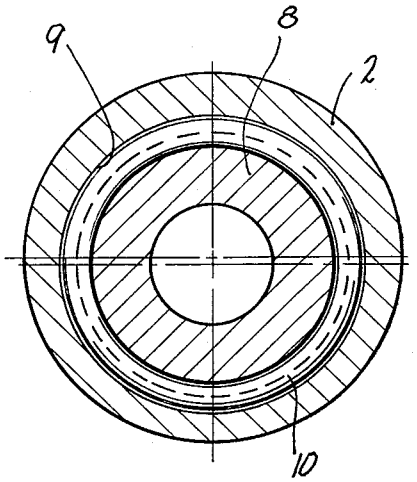
FIG-5

DEVICE FOR MAINTAINING IN POSITION THE PISTON OF A FASTENER TOOL

The present invention relates to devices for maintaining in position the piston of a power-actuated fastener tool.

It is known that with power-actuated fastener tools prior to firing the piston occupies a clearly defined position within the barrel, and the energy transmitted to the fastener depends on this position. For this reason means are provided which, when the tool is operated, in principle prevent the piston from sliding in the barrel. Known means comprise, for example, a circular segment mounted on the rear end of the piston or by this end being given a certain conicity so as to maintain it in place in a correspondingly shaped portion of the barrel.

The disadvantage of these known systems is that they are located in a contact area with the hot gases and therefore necessitate either the use of metal, thereby causing considerable friction, or very tight tolerances, thereby causing an increase in the cost price without, however, preventing rapid wear.

The invention aims at obviating these disadvantages and to this end provides on the front end portion of the plunger or piston a retaining ring mounted in the barrel with the interpositioning of a flexible joint, preferably a resilient O-ring, in such a way that the bore of the ring is slightly off-center relative to the barrel axis and thus also with respect to the piston axis when the joint is not deformed.

As a result of this off-center positioning, it is obvious that when the piston is in the rear position and its end is engaged in the bore of the ring the joint is deformed and a frictional force is exerted by the ring on the piston preventing the latter from freely sliding within the barrel. However, this force is calculated in such a way that it does not brake to too great an extent the piston movement at the time of firing. The desired off-center positioning can be obtained in various ways. For example, the joint can be located in an eccentric groove of the barrel or in an eccentric groove on the ring. It can also be obtained by rendering off-center the bore of the ring or a recess in which the ring is mounted in the barrel.

The device according to the invention particularly has the advantage of being positioned in a zone which is protected from hot gases making it possible, for example, to use rubber as the joint material which only causes slight friction and does not impose tight tolerances.

In a non-limitative manner the attached drawings show several embodiments of the device according to the invention.

FIG. 1 is a longitudinal section of the front portion of a power-actuated fastener tool equipped with the device according to the invention;

FIG. 2 is a view on a larger scale in axial section of a variant of the retaining ring in the barrel;

FIG. 3 is a sectional view along the line III—III of FIG. 2;

FIG. 4 is a view similar to that of FIG. 3 of another variant;

FIG. 5 is also a view similar to FIG. 3 of yet a further variant.

FIG. 1 shows the front portion of a power-actuated fastener tool with piston 1 slidingly mounted in and substantially coaxial with barrel 2. At the front of the barrel is fitted guide 3 wherein is located a fastener 4. At the front of the barrel is mounted the device 5 for the rearward return of piston 1.

The front end 6 of the piston is engaged in the bore 7 of a ring 8, for example made from steel. This ring is mounted in a recess 9 in the front portion of barrel 2 with the interpositioning of an O-ring 10. This O-ring is positioned in a groove 11 of the barrel which is off-center relative to the axis of piston 1.

Due to this off-center positioning, the piston causes the deformation of O-ring 10 and therefore ring 8 exerts a frictional force on the piston and prevents it from sliding during the operations of the tool. However, this force is insufficient to impede sliding at the time of firing.

In the embodiment of FIGS. 2 and 3 the O-ring 10 is located, not in a groove in the barrel but in a groove 12 of ring 8, and it is groove 12 which is off-center, its axis 13 being staggered relative to the axis 14 of piston 1.

In the embodiment of FIG. 4 the bore 7 of ring 8 is rendered off-center.

In the embodiment of FIG. 5 the recess 9 in barrel 2 is rendered off-center.

What is claimed is:

1. A device for releasably maintaining the position of a piston in a power-actuated fastener tool, said device comprising means forming a ring in a barrel of the tool, said ring having a bore through which a forward end of said piston continuously extends, the axis of said bore being off-center with respect to the axis of said barrel, and said piston and said barrel being substantially coaxial, and resilient means sandwiched between an outer surface on said ring and an inner wall of said barrel, said resilient means being compressed by reason of said piston extending through said ring bore to cause said ring to exert a frictional retaining force on said piston.

2. The device of claim 1 wherein said resilient means is an O-ring.

3. The device of claim 1 wherein said resilient means is mounted in an eccentric recess within said barrel.

4. The device of claim 1, wherein said resilient means is mounted in an eccentric groove in said ring.

5. The device of claim 1, wherein said ring bore is off-center from said outer surface of said ring.

* * * * *